United States Patent [19]

Gros

[11] 3,966,527

[45] June 29, 1976

[54] MANUFACTURE OF ARTICLES OF A SUBSTANTIALLY SACK-LIKE OR TUBULAR STRUCTURE

[76] Inventor: Eugene Gros, 9 Harman Drive, London NW2, England

[22] Filed: May 6, 1975

[21] Appl. No.: 575,075

Related U.S. Application Data

[62] Division of Ser. No. 358,953, May 10, 1973, abandoned.

[30] Foreign Application Priority Data

June 4, 1970 United Kingdom ..... 26997/70

[52] U.S. Cl. ..... 156/250; 156/273

[51] Int. Cl.[2] ..... B32B 31/00

[58] Field of Search ..... 156/160, 250, 273, 380, 156/510, 521, 566, 70

[56] References Cited

UNITED STATES PATENTS

| | | | |
|---|---|---|---|
| 2,842,298 | 7/1958 | Hill | 223/60 |
| 2,957,792 | 10/1960 | Magid | 156/70 |
| 2,976,199 | 3/1961 | Rand | 156/250 |
| 3,006,801 | 10/1961 | Pfeffer, Jr. | 156/380 |
| 3,225,764 | 12/1965 | Magid | 156/288 |
| 3,726,745 | 4/1973 | Gidge et al. | 156/510 |

*Primary Examiner*—Douglas J. Drummond
*Attorney, Agent, or Firm*—William J. Daniel

[57] ABSTRACT

The invention is concerned with the manufacture of articles of a substantially sack-like or tubular structure and made of a material in sheet or strip form, the articles having openings with elastic bands therearound so as to resist circumferential expansion of the openings.

The invention is particularly concerned with the continuous manufacture of babies' pants, and more especially with the securing, for example by high frequency welding, of elastic bands to the waist and leg openings.

A succession of support members for the blanks is indexed to a plurality of work stations, in sequence, clamp elements being provided on the support members for holding the elastic bands in place and juxtaposing marginal portions of the material, preferably a plastics material, in a suitable manner for performing the welding operation.

9 Claims, 3 Drawing Figures

INVENTOR:

Eugene GROS

BY Karl F. Ross

Attorney

INVENTOR:

Eugene GROS

BY Karl F. Ross

Attorney

MANUFACTURE OF ARTICLES OF A SUBSTANTIALLY SACK-LIKE OR TUBULAR STRUCTURE

This is a division of Ser. No. 358,953, filed May 10, 1973, now abandoned.

This invention relates to the manufacture of articles of a substantially sack-like or tubular structure and of the kind comprising a piece of material in sheet, strip or tube form having an elastic band, strip or thread (hereinafter referred to as an "elastic band") incorporated therein and extending at least partially around its perimeter or the perimeter of an opening therein.

Such articles will hereinafter be referred to as "articles of the kind specified".

Whilst not limited thereto, the invention is especially concerned with the manufacture of articles of the kind specified wherein either a said piece of material is folded over and joined along two opposite margins, or two said pieces are joined along their margins, so as to define a said sack-like or tubular structure. Openings may also be provided in the region of a said fold and/or such joined sides, and provided with elastic bands. Examples of such last-mentioned articles are babies' pants and also pants for male and female children and adults, and bathing and other trunks, in which the said openings surround the waist and/or the legs of the wearer.

In its broadest aspect, however, the invention is also applicable to the manufacture of a variety of other articles, such as other garments, e.g. bathing trunks or vests, as well as bathing caps or protective covers for enveloping a variety of objects, e.g. scientific apparatus.

The material from which the articles of the kind specified are made is preferably a plastics material, such as polyvynilchloride, but could, for example, also be nylon, polyethylene, rayon or even a woven, non-woven or knitted fabric, and the joining of the sides should be construed accordingly; i.e. it may, but need not necessarily, comprise a welding operation and could, depending on the nature of the material, be accomplished by sewing or the application of an adhesive.

Because of its special utility in relation to the manufacture of babies' pants and the fact that it has been developed for this particular application, the invention will, however, hereinafter for convenience be explained and particularly described in this context.

A variety of methods of manufacturing babies' pants have previously been proposed, but they are time consuming and require a considerable amount of manual labour; consequently they are comparatively costly.

One such method entails cutting off a length of material, doubling it to form a front and back portion, and cutting off two corners from the folded edge to form the leg openings, the sides having been welded together. Stretched rubber bands are then slipped over the two leg openings and the waist opening, and welded in position. These various steps are performed wholly or predominantly manually.

It is an object of the present invention to provide a machine and a method for the manufacture of articles of the kind specified which enable such articles to be made with less manual effort and hence more economically, and which are adaptable, by the provision of the further features hereinafter described, to the more economical manufacture of babies' pants.

Thus, according to a first aspect of the invention, a machine for the manufacture of articles of the kind specified is provided, wherein a plurality of support members, each constructed to support an article blank internally thereof whilst a manufacturing operation is performed, and a plurality of operating stations, each for carrying out a said operation on the article blanks, are arranged sequentially to be brought into operational juxtaposition by relative movement between the support members and the operating stations, the said operating stations consisting of or including means for applying an elastic band to an article blank, means for securing a said band to a said blank, and means for discharging or ejecting the finished articles from the machine.

A preferred form of machine according to the invention also includes an operating station having means for parting article blanks off a continuous supply of material to the machine.

According to a second aspect of the invention, a method of manufacturing articles of the kind specified is provided, wherein article blanks are each internally supported on a support member whilst a manufacturing operation is performed and the article blanks are sequentially presented to a plurality of operating stations, each for carrying out a said operation of the article blanks, by relative movement between the support members and the operating stations, the said operations consisting of or including applying an elastic band to an article blank, securing a said band to a said blank, and discharging or ejecting the finished articles from the support members.

In a preferred form of method according to the invention, article blanks are parted off a continuous supply of material to the support members prior to the operations hereinbefore specified.

The invention also includes within its scope articles of the kind specified when made in a machine or by a method according to the said first and second aspects of the invention respectively.

An embodiment of the invention, in the form of a machine for, and method of, manufacturing babies' pants will now be described, by way of example only, with reference to the accompanying diagrammatic drawings in which.

Figure 1:
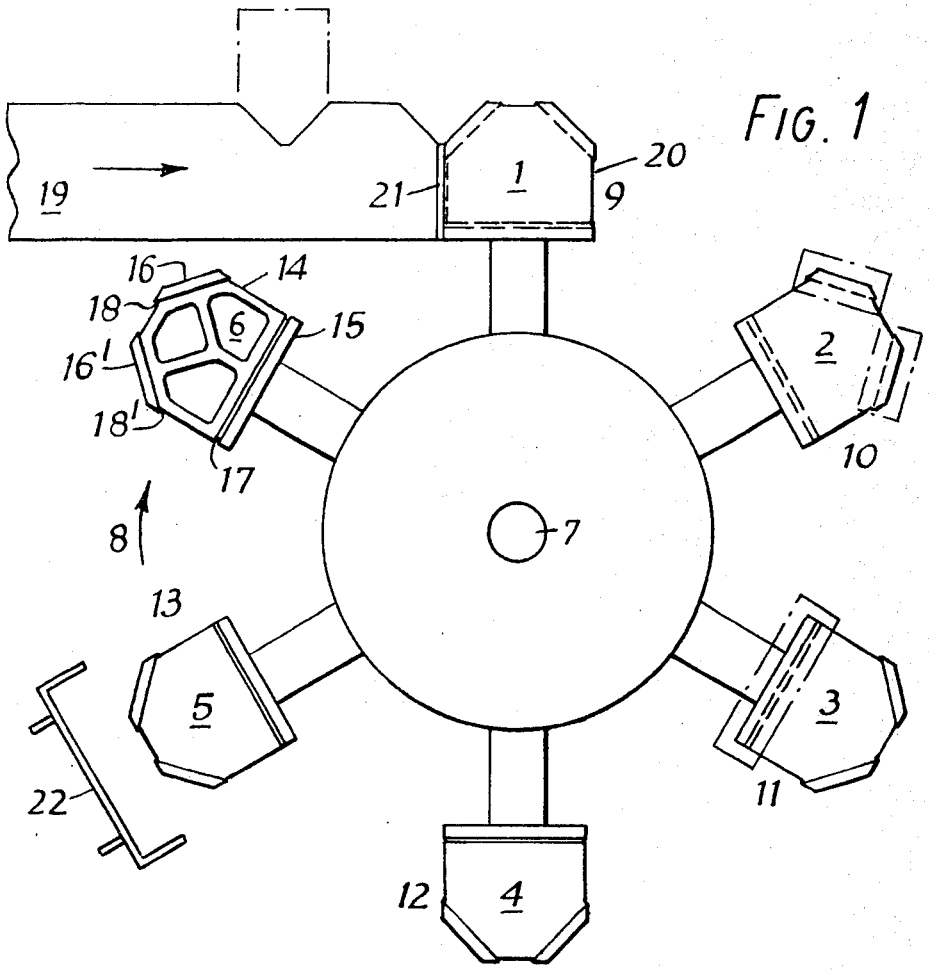
FIG. 1 is a simplified plan view of the machine.

Referring to FIG. 1, six support members 1 – 6 are mounted for rotation about a common axis 7 in the direction of the arrow 8. The support members 1 – 6 are relatively equiangularly spaced, means (not shown) being provided to index them stepwise from a first opeating station 9 to four further operating stations 10 – 13 for the performance of a succession of manufacturing operations on article blanks carried on the support means. The five operating stations 9 – 13 are relatively angularly spaced by 60°, there being an angular spacing of 120° between stations 13 and 9.

The support members 1 – 6 are in the form of substantially flat plates having an outline approximating to that of a pair of babies's pants lying flat. Each support member includes a first element such as 14 (hereinafter referred to as a "dolly") and a clamp element such as 15 in the region where an elastic waist band is to be secured to the pants, as well as two further clamp elements 16,16' which are alike and similar to the element 15, the elements 16,16' being located in the regions where an elastic band is to be secured to each of the leg openings of the pants. The dolly 14 on the one hand and the clamp elements 15,16,16' on the other hand are relatively movable; more particularly, in the particular machine described, the clamp elements are each movable from a first position in which they define, together with the dolly 14, circumferential grooves such as 17,18,18' at the locations where the elastic bands are to be secured, to a second position in which, again together with the dolly 14, they each define a substantially closed circumferential channel for housing or accommodating the said elastic band during a portion of the operating cycle.

Briefly, the operations carried out at the five operating stations are as follows:

Station 9: Folded plastics sheet 19 is supplied to the machine from a continuous supply thereof (not shown), with the leading edge 20 welded so as to provide a loop or end wall for the supply of the sheet material for engagement by the dolly as it approaches this station so as to index a portion of the material thereto. The leading edge 20 is also cut to shape to define the leg opening in that edge. At this station the edge 21 is welded to form a marginal seam and then parted through the weld, thereby to define not only a marginal seam for the parted off blank, but also the loop or end wall referred to above for the next indexing step, this loop or end wall also defining the leading edge of the next succeeding blank.

Station 10: Rubber elastic bands are applied to the leg openings.

Station 11: A rubber elastic waist band is applied to the blank.

Station 12: The rubber bands at the leg openings and waist are welded in position.

Station 13: The finished pants, which are inside out, are pulled off and at the same time turned the right way round.

The 120° angular spacing between Station 13 and the first station, viz. Station 9, previously mentioned is provided so as to present the requisite clearance for the support members passing therebetween to engage the material as described in relation to Station 9.

It will be appreciated that when a fresh roll of material is begun, it is necessary to weld the leading edges of the material, which is supplied to the machine folded over, with a fold radially outward of the machine, together, but thereafter, as described in relation to Station 9, this weld is provided in the course of the operating steps performed at this station at each indexing step.

A cutter (not shown) for cutting out a triangle, two sides of which define the left and right hand leg openings respectively of two adjacent blanks can be positioned at, or anywhere convenient ahead of, Station 9.

At Station 10 the two elastic bands are applied to the leg openings by devices (not shown) which each include four fingers which carry a said elastic band stretched and cause it to be placed in the groove 18 and 18' respectively. Thereupon the bands are clamped in position by the clamp elements 16 and 16' respectively.

At Station 11 the elastic band for the waist is applied by a similar device, placed in the groove 17 and clamped by the clamp element 15.

The welding operation which takes place at Station 12 is described hereinafter with reference to FIGS. 2 and 3.

The discharge, ejection or withdrawal of the finished pants at Station 13 is done by the movement of a frame 22 over the dolly. Metal fingers are inserted between the pants and the dolly at the waist; the frame with the fingers is then withdrawn outwards, sripping the pants from the dolly. As the two legs are still retained in the grooves 18,18' by the leg elastics, the effect of the stripping is to turn the pants inside out, i.e. since they were processed on the machine on their insides, to turn them the right way round.

The pants are transferred to a loose-fitting plate or slide (not shown) and caused to drop into a receptacle therefor.

Figure 2:
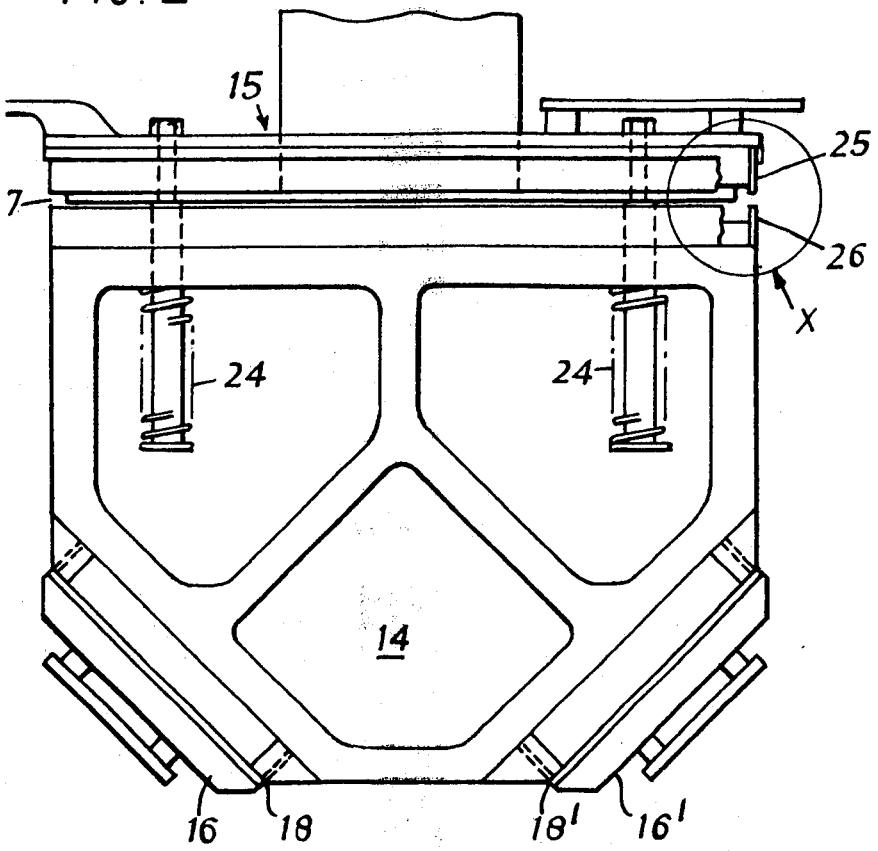
FIG. 2 is a plan view of one of the support members, drawn to a larger scale and showing the dolly element and the clamp elements thereof in somewhat greater detail in a first relative position.

Referring now to FIG. 2, the clamp element 15 is shown in a first position relative to the dolly element 14, in which they define between the circumferential groove 17, which is shown to contain the waist elastic band 23. The two elements are resiliently biassed into a second relative position in which (as shown in FIG. 3) they define between them a substantially closed circumferential channel housing the band 23, by compression springs 24. During the appropriate part of the operating cycle, the two elements are moved and held apart in the said first relative position by any convenient mechanism, e.g. a cam mechanism, well known to those skilled in the art and therefore not shown.

The means for securing the elastic band takes the form of a live electrode 25 on the clamp element 17 and an electrode 26 at earth potential on the dolly 14, which have a high frequency supply applied thereacross from a supply of high frequency electrical energy (not shown) and are arranged to co-operate to define welding means, when the elements 14 and 15 are in the second said relative position, and constructed so as to produce a circumferential welded seam around the waist of the pants.

The clamping and welding arrangement for the leg openings is similar and will therefore not be described in detail.

Figure 3:
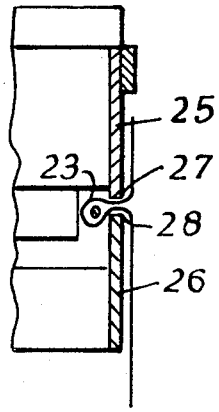
FIG. 3 is a scrap view of the region indicated by X in FIG. 2 in a second relative position of the elements.

As will be seen from FIG. 3, the elastic band 23 has the effect of folding the plastics material of the pants over in the manner shown in the figure and closely to juxtapose two portions 27, 28 of the pants for the electrodes 25,26 to perform the required welding operation around the band 23.

It will be appreciated that many variations of the machine and method particularly described are possible, without departing from the scope of the invention. Examples of such variations are the following:

a. The number of stations may be altered. For instance, eight stations may be used, with one station for each of the elastic bands for the legs, and with separate stations for welding the leg openings and the waist opening.

b. The sequence of operations may be varied by placing the waist elastic band in position before the leg bands.

c. The material may be joined by adhesives instead of welding; alternatively, heat sealing, ultrasonics or cold pressure welding may be used.

d. The method of supplying the sheet may be varied; for instance, instead of the aforesaid triangular cut-out being provided ahead of Station 9, the material may be left uncut and the cut-out provided beyond that station.

e. The blanks may be welded before being supplied to the machine, and fed to the latter either manually or automatically as discrete work pieces.

f. It is possible to use more than one dolly at each station; for instance, output can be doubled by having two dollies (and associated clamp elements) either side-by-side or one above the other.

g. An endless conveyor could be utilised on which the various operations would be performed, instead of the turntable device shown.

h. The pants (or other articles as hereinbefore specified) need not be of a plastics material, but instead of paper or other material having a surface which can be bonded (e.g. by welding or the use of adhesives). For example, the material may be coated so as to provide a said surface.

j. Instead of being pulled off the support means, the finished articles could be removed from the machine by compressed air or the application of a vacuum.

What I claim is:

1. A method of producing a generally three-sided tubular article from a continuous length or web of sheet material, which comprises the steps of feeding along a path having at least a linear terminal portion two continuous web sections, one superposed upon the other, which are joined along a common edge to provide when viewed in transverse cross-section, a generally U-shaped web configuration having a transverse dimension generally corresponding to the depth dimension of said tubular article sealing together the leading edges of said web sections along a line extending generally transversely of the web length to form the leading end into a two-sided pocket, advancing a generally flattened supporting form in a plane generally coincident with the linear web path portion along an angular path intersecting with said terminal web path portion to introduce said flattened form into said semi-pocket with the leading end of said form engaging said sealed web end, sealing together said two web sections along a transverse strip region immediately proximate the trailing end of said form to close the third side of said end pocket with the form disposed therein, separating the thus-formed pocket from the web sections by severing through said sealed strip to concurrently form a further two-sided semipocket, transfering the separated article containing the supporting form from said terminal path portion, and repeating said advancing, sealing, separating and transfering steps with further supporting forms.

2. The method of claim 1 including the steps of applying an elastic band around the periphery of the open fourth side of said tubular article and stripping the same from said form.

3. The method of claim 1 wherein said tubular article has openings at the corners defined by the intersections of the three closed sides thereof and including the further steps of severing from said web sections a first corner portion between said sealed leading end and said common joined edge and subsequently before each said form is introduced to said semi-pocket notching said web sections from their common joined edge to remove a V-shaped portion thereof symmetrical with each of said sealed transverse strip regions and form openings in the adjacent corners of successive pairs of the ultimate articles.

4. The method of claim 2 including the further steps of applying an elastic band around each said corner opening and then stripping said article from said form.

5. The method of claim 1 wherein a plurality of said supporting forms are moved cyclically in an endless path including said angular path portion converging with said linear web path portion.

6. The method of claim 4 wherein said forms are advanced stepwise through said cyclical path and said web sections are advanced stepwise along its path by the continued movement of each said form after the same has been introduced into a web semi-pocket.

7. The method of claim 4 wherein said elastic band applying and stripping steps are performed at subsequent points on said endless path.

8. The method of claim 1 wherein said angular converging path portion is arcuate.

9. The method of claim 1 wherein a continuous length of said sheet material is doubled over laterally upon itself to form said U-shaped web configuration.

* * * * *